US009960502B2

(12) United States Patent
Drew et al.

(10) Patent No.: US 9,960,502 B2
(45) Date of Patent: May 1, 2018

(54) WIRE HARNESS ASSEMBLY

(71) Applicant: Delphi Technologies, Inc., Troy, MI (US)

(72) Inventors: Geroge Albert Drew, Warren, OH (US); Kurt Paul Seifert, Cortland, OH (US); Gina Sacco, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 61 days.

(21) Appl. No.: 15/282,343

(22) Filed: Sep. 30, 2016

(65) Prior Publication Data

US 2017/0018859 A1 Jan. 19, 2017

Related U.S. Application Data

(62) Division of application No. 13/950,855, filed on Jul. 25, 2013, now abandoned.

(51) Int. Cl.

| | |
|---|---|
| ***H01R 43/04*** | (2006.01) |
| ***H01R 4/18*** | (2006.01) |
| ***H01R 4/62*** | (2006.01) |
| ***H01R 43/02*** | (2006.01) |
| ***H01R 43/28*** | (2006.01) |
| *H01R 101/00* | (2006.01) |

(52) U.S. Cl.

CPC ..... *H01R 4/185* (2013.01); *H01R 4/187* (2013.01); *H01R 4/625* (2013.01); *H01R 43/0235* (2013.01); *H01R 43/28* (2013.01); *H01R 2101/00* (2013.01); *Y10T 29/49179* (2015.01); *Y10T 29/49181* (2015.01)

(58) Field of Classification Search

CPC ..... H01L 2224/73265; Y10S 430/146; Y10T 29/49098; Y10T 29/49101; Y10T 29/49174; Y10T 29/49179

USPC ..... 29/861, 854, 857, 860, 863, 867, 874, 29/878; 228/56.3, 246; 439/519, 620, 439/626, 730, 874, 884

See application file for complete search history.

(56) References Cited

U.S. PATENT DOCUMENTS 3,601,783 A * 8/1971 Loose ..... H01R 4/024 439/730

6,334,798 B1 * 1/2002 Ushijima ..... H01R 4/187 439/203

FOREIGN PATENT DOCUMENTS

DE 19902405 * 8/2000 ..... H01R 4/187

* cited by examiner

*Primary Examiner* — Thiem Phan

(74) *Attorney, Agent, or Firm* — Robert J. Myers

(57) ABSTRACT

A wiring harness assembly is presented. The wiring harness assembly is formed by a method that includes the steps of crimping an electrical wire cable within a crimping feature of an electrical terminal having wire strands protruding from the crimping feature and fusing the wire strands of protruding portion, or "wire brush" so that the wire strands are in intimate contact, thereby eliminating voids between individual wire strands of the wire brush. The wires may be fused by laser welding, soldering, or brazing. The method may be especially beneficial for wire strands having an insulative oxide layer, such as aluminum. The bonding reduces the resistance between the wire strands due to insulating oxide layers on the surface of the wire strands and inhibiting of corrosion by eliminating inter-strand gaps where electrolytes in solution may enter and cause galvanic corrosion.

9 Claims, 4 Drawing Sheets

WIRE HARNESS ASSEMBLY

CROSS-REFERENCE TO RELATED APPLICATION

This application is a divisional application and claims the benefit under 35 U.S.C. § 120 of U.S. patent application Ser. No. 13/950,855, filed Jul. 25, 2013, the entire disclosure of which is hereby incorporated herein by reference.

TECHNICAL FIELD OF THE INVENTION

The invention generally relates to method of attaching an electrical terminal to an electrical wire cable, and more particularly relates to a method of fusing wire strands of the cable protruding from the terminal so that the wire strands are in intimate contact, thereby eliminating voids between individual wire strands of the protruding portion.

BACKGROUND OF THE INVENTION

Aluminum wire cables are increasingly being incorporated in automotive wiring harnesses. There are several factors driving this trend. First, the market price of copper, traditionally used for automotive wiring, is significantly higher and more volatile than that of aluminum. Second, the weight of aluminum wiring is approximately half that of the equivalent copper wiring. The push for more fuel efficient vehicles is requiring weight to be taken out of the vehicle and aluminum-based wire cables provide a good opportunity to reduce weight by substituting aluminum cable for copper cable.

Aluminum does have some disadvantages in vehicle wiring. Aluminum cable typically has multiple strands in the wire cable to increase flexibility of the cable. Aluminum forms an oxide layer that has a lower conductivity than aluminum and is very hard. Because these aluminum oxides form almost instantaneously on the surface of the aluminum wires, individual wire strands in the cable do not connect well electrically to each other. Additionally, aluminum wire strands in a crimped connection can also deform over time due to stress relaxation and creep. As the aluminum wire in a termination changes shape, electrical resistance can increase causing increased connection resistance, heat build-up, and connector failure. Because of these challenges, conventional crimped connections to aluminum cable constructions with a large number of strands do not provide a robust low resistance connection that will withstand environmental exposure over time. Alternate connection technologies are required to help interconnect each strand in the cable core so they act as a single conductor. It may also be desirable to use existing terminals designed for copper cable connection systems to avoid the expense of designing new terminals made especially for aluminum cable.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with one embodiment of this invention, a method of connecting an electrical wire cable having a plurality of uninsulated wire strands to an electrical terminal is provided. The method includes the step of crimping an uninsulated end of the electrical wire cable within a crimping feature of the electrical terminal. A portion of the plurality of uninsulated wire strands protrudes from the crimping feature. The method further includes the step of fusing the wire strands of said protruding portion so that the wire strands are in intimate contact, thereby eliminating voids between individual wire strands of the protruding portion. The wire strands of the protruding portion may be fused to the electrical terminal. The wire strands may be formed of aluminum.

In another embodiment of the present invention, a wiring harness assembly is provided. The wiring harness assembly includes an electrical wire cable including an end having a plurality of uninsulated wire strands and an electrical terminal that is attached to the electrical wire cable by the method described above.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
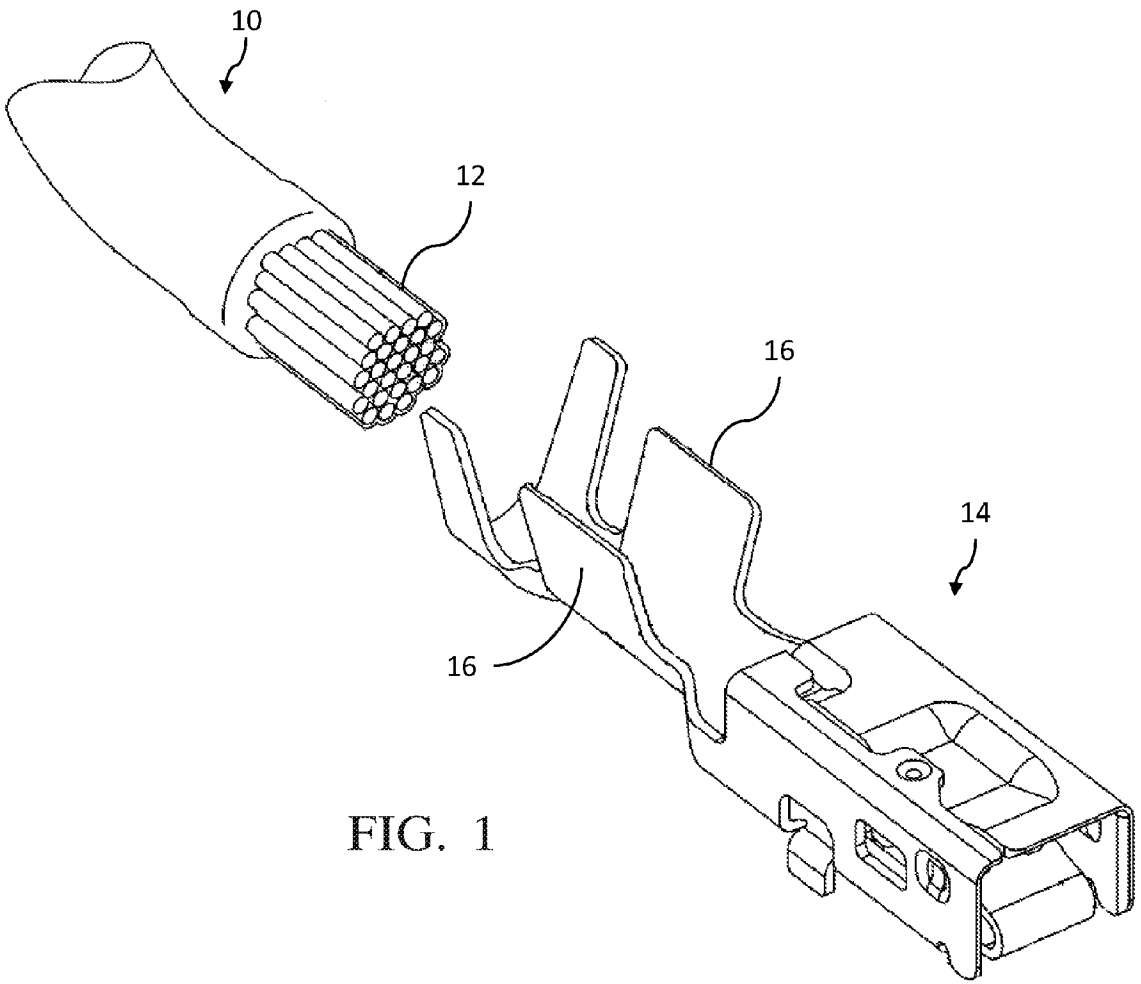
FIG. 1 is a perspective view of an electrical wire cable unattached to an electrical terminal in accordance with one embodiment.

FIG. 1 illustrates a non-limiting example of an electrical wire cable 10, such as an aluminum wire cable, having multiple uninsulated wire strands 12. As used herein, aluminum may refer to pure aluminum or and aluminum based or aluminum containing alloy. The electrical cable 10 is electrically and mechanically attached to an electrical terminal 14. The terminal 14 in the illustrated example is a female socket connector and includes at least a pair of crimp wings 16 configured to connect the terminal 14 to the wire strands 12. The terminal 14 may be formed of a copper based material. As used herein, the copper based material may be pure copper, a copper based alloy, or a copper containing alloy. The copper based material may also be plated with another material, such as a tin based alloy, to enhance corrosion resistance of the terminal 14. The design and manufacture of electrical terminals having crimp wings and the use of crimp wings to attach wire cables to electrical terminals are well known to those skilled in the art. The terminal 14 as illustrated in FIG. 1 is a female socket terminal. Alternatively, other embodiments may include a male plug terminal, ring terminal, hook terminal, or other terminal types configured to be attached to wire cables via a crimping feature as are well known to those skilled in the art.

Figure 2:
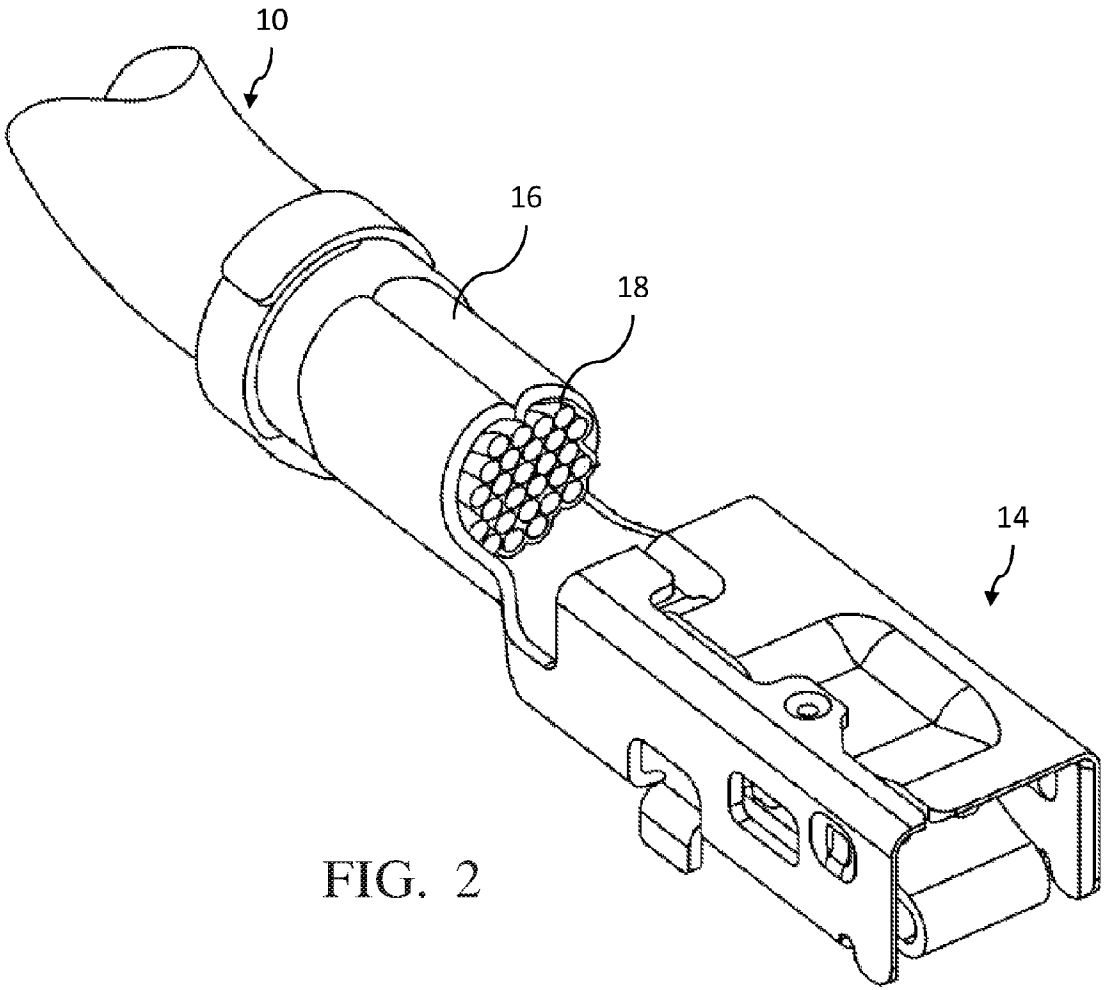
FIG. 2 is a perspective view of an electrical wire cable attached to an electrical terminal in accordance with one embodiment.

When an electrical terminal 14 that has a crimping feature 16, such as a pair of crimping wings 16 illustrated in FIG. 1, is crimped to a wire cable 10 having multiple wire strands 12, an end portion 18 of the individual wire strands 12 typically protrude from the crimp wings 16, forming what may be called a "wire brush" as illustrated in FIG. 2.

Figure 3:
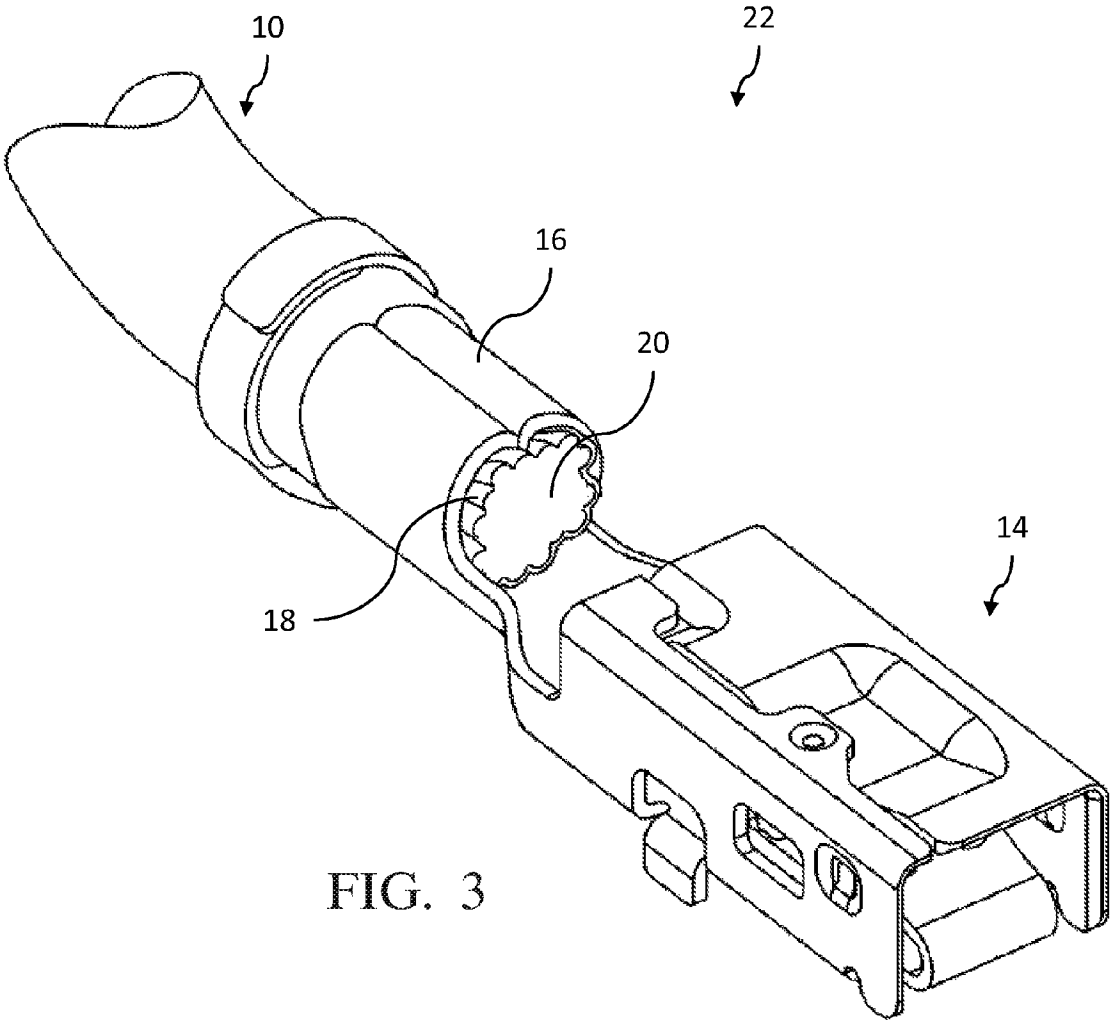
FIG. 3 is a perspective view of an electrical wire cable attached to an electrical terminal with a protruding portion metallurgically fused in accordance with one embodiment.

FIG. 3 illustrates a non-limiting example of an electrical wire cable 10 and electrical terminal 14 wherein at least a portion 20 of the individual wire strands 12 of the wire brush 18 are bonded to one another by a thermal process such as welding, brazing, or soldering to produce a metallurgical bond between at least a majority of the strands 12 of the cable 10, thus providing a benefit of reducing the resistance between the wire strands 12 due to insulating oxide layers on the surface of the wire strands 12. Laser welding may be an effective method of welding the stands 12 because of the small target area of the wire brush 18 and the precision required to fuse the strands 12 of the wire brush 18 without adversely affecting the terminal 14 or wire cable 10.

One function of bonding the wire strands 12 together is to minimize inter-strand electrical resistance. It is also desirable to bond the wire brush 18 to the electrical terminal 14, thus providing a low resistance connection between the wire cable 10 and the terminal 14. This may occur as a plating material on the electrical terminal 14 melts and bonds to the welded strands 12 in the bonded portion 20. However, bonding the wire brush 18 to the electrical terminal 14 is not necessary. The crimp wings 16 may include features to break-up oxides on the wires to improve electrical conductivity between the wire strands 12 and the terminal 14. An example of such features may be found in U.S. Pat. No. 8,485,853 granted to Seifert, et al on Jul. 16, 2013. Additives such as flux, solder paste, brazing rod/wire or welding rod/wire may be applied the bonded portion 20 to improve the quality of the metallurgical bond between the strands 12.

Another benefit of metallurgically bonding the wire strands 12 of the wire brush 18 is the inhibition of corrosion at the bonded portion 20. Whenever two different types of metal, such as an aluminum-based wire and a copper based terminal, are in contact with each other in the presence of an electrolyte in solution, there is risk of galvanic corrosion. The aluminum-based wire will act as an anode in a galvanic reaction and can corrode when in contact with a copper-based terminal. If the bonding process causes metal to reflow to fill the open spaces between the strands 12, it can seal the bonded portion 20 at the front of the crimped connection between the wire cable 10 and the terminal 14 to prevent electrolytes in solution from entering inter-wire spaces, voids, or gaps in the crimped connection. Use of sacrificial metals, such as zinc or magnesium, in the welding/brazing process (e.g. zinc additives in a solder paste, solder flux, or a brazing/welding rod) may provide enhanced corrosion protection. Because these sacrificial metals are more anodic relative to aluminum in the galvanic series, the sacrificial metals will corrode before the aluminum, thus preserving the integrity of the termination. Additional corrosion protection, such as the application of a sealant, may be applied to the end of the terminal 14 opposite the bonded portion 20 where the uninsulated wire strands 12 exit the crimp wings 16. An example of such a method of applying a sealant to a crimped wire connection may be found in U.S. Pat. No. 8,181,343 granted to Martauz, et al on May 22, 2012.

As illustrated in FIG. 3, the cut end of the wire cable 10 protruding from the front of the crimping wings 16 is fused to become the bonded portion 20. Alternatively, the uninsulated wire strands 12 protruding from the back of the crimping wings 16 opposite the cut end may also be fused to become a bonded portion 20.

Figure 4:
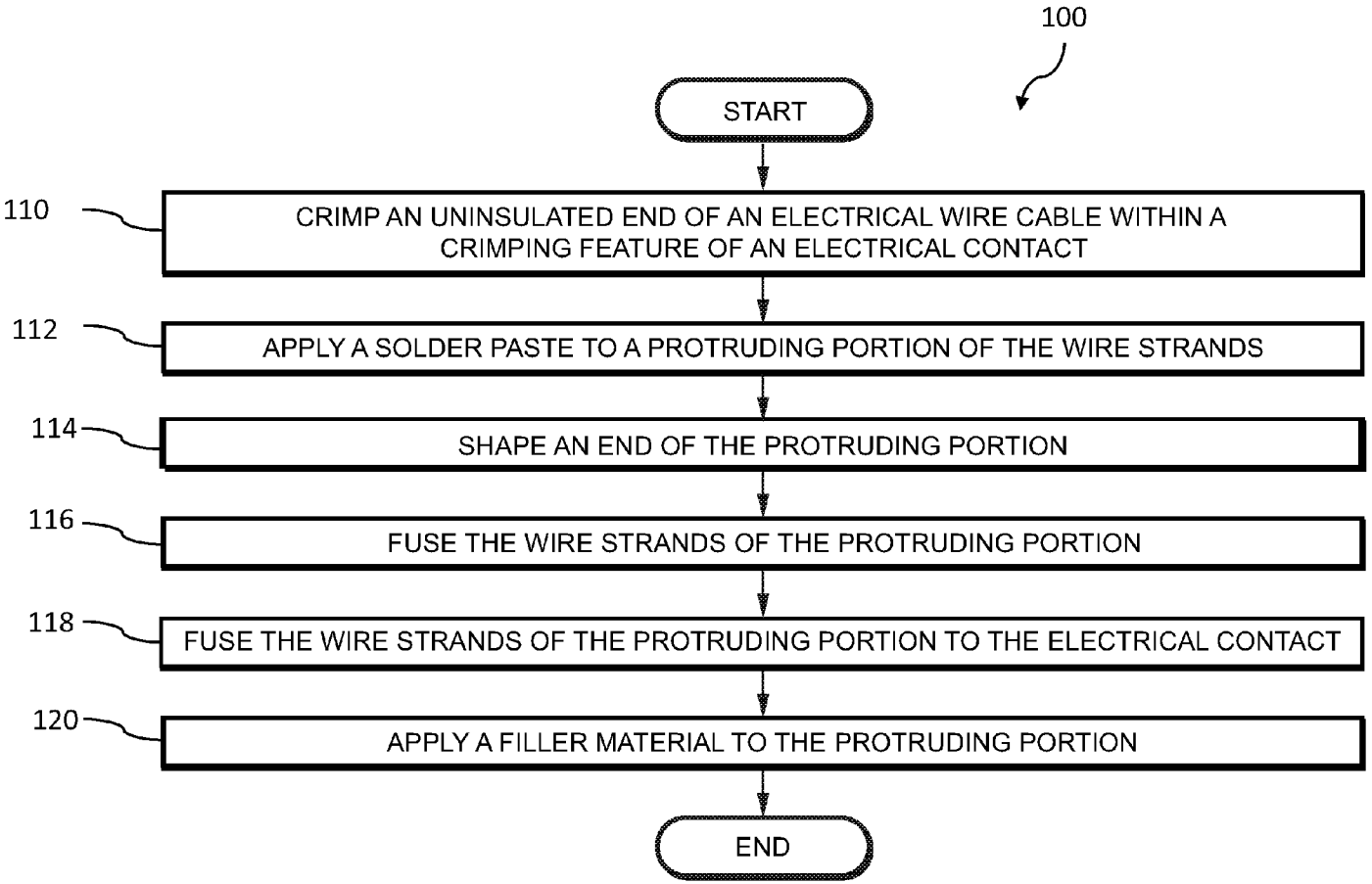
FIG. 4 is a flow chart of a method of connecting an electrical wire cable having a plurality of uninsulated wire strands to an electrical terminal in accordance with one embodiment.

FIG. 4 illustrates a non-limiting example of a method 100 of connecting an electrical wire cable 10 having a plurality of uninsulated wire strands 12 to an electrical terminal 14.

In step 110, CRIMP AN UNINSULATED END OF AN ELECTRICAL WIRE CABLE WITHIN A CRIMPING FEATURE OF AN ELECTRICAL TERMINAL, an uninsulated end of the electrical wire cable 10 is crimped within a crimping feature 16 of the electrical terminal 14. A portion 18 of the plurality of uninsulated wire strands 12 protrudes from the crimping feature 16 forming a "wire brush". The crimping feature 16 of the electrical terminal 14 may define a pair of crimp wings 16 as illustrated in FIGS. 1-3.

In step 112, APPLY A SOLDER PASTE TO A PROTRUDING PORTION OF THE WIRE STRANDS, according to one embodiment, a solder paste is applied to the protruding portion 18 of the wire strands 12, otherwise referred to as the wire brush 18. The solder paste may comprise zinc, such as a tin-zinc or zinc-aluminum solder, to serve as a sacrificial metal to inhibit corrosion of an aluminum wire cable crimped to a copper electrical terminal. Step 112 may be performed prior to step 116.

In step 114, SHAPE AN END OF THE PROTRUDING PORTION, according to one embodiment, the wire brush 18 or protruding portion 18 is shaped to provide a smooth end of the wire brush 18 because the end of the wire brush 18 may be uneven following the crimping of the wire in step 110. The end of the wire brush 18 may be shaped by trimming the ends of the individual wire strands 12 by cutting or grinding. Step 114 may be performed prior to step 116.

In step 116, FUSE THE WIRE STRANDS OF THE PROTRUDING PORTION, the wire strands 12 of the wire brush 18 as fused so that the wire strands 12 are in intimate contact, thereby eliminating voids between individual wire strands 12 of the protruding portion 18. The end face of the wire brush 18 may be fused or the wire strands 12 of the entire protruding portion 18 may be fused. According to one embodiment, the wire strands 12 are fused by irradiating the protruding portion 18 with laser radiation (e.g. coherent light beam) in a process commonly known as laser welding. Only the protruding portion 18 of the wire strands 12 is irradiated. According to another embodiment, thermal energy is applied to the protruding portion 18 using a process such as brazing, soldering, or welding.

In step 118, FUSE THE WIRE STRANDS OF THE PROTRUDING PORTION TO THE ELECTRICAL TERMINAL, according to one embodiment, the wire strands 12 of the protruding portion 18 are also fused to the electrical terminal 14.

In step 120, APPLY A FILLER MATERIAL TO THE protruding portion 18, according to one embodiment, a filler material, such as solder paste, welding rod, or brazing rod is applied to the protruding portion 18. The filler material may comprise zinc. Step 120 may be performed as part of step 116.

Accordingly, a method 100 of connecting an electrical wire cable 10 having a plurality of uninsulated wire strands 12 to an electrical terminal 14 and a wiring harness assembly 22 manufactured by the method 100 and having an electrical wire cable 10 and an electrical terminal 14 is provided. The wire cable 10 is attached to the terminal 14 by a crimping feature 16 and the wire strands 12 of a portion 18 of the cable 10 that protrudes from the crimping feature 16 are fused, bonded, or welded to metallurgically bond the wire strands 12 to one another. This bonding of the strands 12 reduces inter-strand resistance and seals the bonded portion 20 against the infiltration of electrolytes that may cause galvanic corrosion of the wire cable 10.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A wiring harness assembly, comprising:

an electrical wire cable including an end having a plurality of uninsulated wire strands;

an electrical terminal attached to the electrical wire cable by the method of:

crimping an uninsulated end of the electrical wire cable within a crimping feature of the electrical terminal, wherein a portion of the plurality of uninsulated wire strands protrudes from the crimping feature;

welding the portion of the plurality of uninsulated wire strands protruding from the crimping feature so that at least a majority of the wire strands are bonded together, thereby eliminating voids between individual wire strands of the portion of the plurality of uninsulated wire strands protruding from the crimping feature; and shaping an end portion of the portion of the plurality of uninsulated wire strands protruding from the crimping feature to provide a smooth end of the portion of the plurality of uninsulated wire strands protruding from the crimping feature.

2. The wiring harness assembly in accordance with claim 1, wherein the wire strands of the entire protruding portion are fused to one another.

3. The wiring harness assembly in accordance with claim 2, wherein the wire strands of the protruding portion are further fused to the electrical terminal.

4. The wiring harness assembly in accordance with claim 1, wherein the crimping feature defines a pair of crimping wings.

5. The wiring harness assembly in accordance with claim 1, wherein the plurality of uninsulated wire strands comprise aluminum.

6. The wiring harness assembly in accordance with claim 1, further comprising a solder paste applied to the portion of the plurality of uninsulated wire strands protruding from the crimping feature.

7. The wiring harness assembly in accordance with claim 6, wherein the solder paste comprises zinc.

8. The wiring harness assembly in accordance with claim 1, further comprising a filler material applied to the portion of the plurality of uninsulated wire strands protruding from the crimping feature.

9. The wiring harness assembly in accordance with claim 8, wherein the filler material comprises zinc.

* * * * *